US005323581A

United States Patent [19]

Jakel

[11] Patent Number: 5,323,581

[45] Date of Patent: Jun. 28, 1994

[54] LIGHTWEIGHT CEMENTITIOUS ROOFING

[76] Inventor: Karl W. Jakel, 3924 Park Pl. #4, Montrose, Calif. 91120

[21] Appl. No.: 876,382

[22] Filed: Apr. 30, 1992

[51] Int. Cl.[5] ..... E04D 1/22

[52] U.S. Cl. ..... 52/519; 52/535; 52/539; 52/541

[58] Field of Search ..... 52/518, 524, 553, 547, 52/548, 550, 543, 560, 546, 541

[56] References Cited

U.S. PATENT DOCUMENTS

| | | | |
|---|---|---|---|
| 329,513 | 11/1885 | Underwood . | |
| 1,469,543 | 10/1923 | Strachan et al. . | |
| 1,575,183 | 3/1926 | Sinnett . | |
| 2,057,003 | 10/1936 | Bugher . | |
| 2,293,744 | 8/1942 | Miles et al. . | |
| 2,353,455 | 7/1944 | Gisondi | 52/548 |
| 2,429,113 | 10/1947 | Warner | 52/547 |
| 2,450,562 | 10/1948 | Robinson et al. . | |
| 2,510,416 | 6/1950 | Pretty . | |
| 2,624,298 | 1/1953 | Farren | 52/553 |
| 2,796,637 | 6/1957 | Miles . | |
| 3,783,570 | 1/1974 | Storch . | |
| 3,852,933 | 12/1974 | Guzzo . | |
| 3,852,934 | 12/1974 | Kirkhuff . | |
| 3,862,532 | 1/1975 | Markos . | |
| 4,240,840 | 12/1980 | Downing et al. . | |
| 4,288,959 | 9/1981 | Murdock . | |
| 4,407,769 | 10/1983 | Harada et al. . | |
| 4,514,947 | 5/1985 | Grail . | |
| 4,637,860 | 1/1987 | Harper et al. . | |
| 4,662,141 | 5/1987 | Miko . | |
| 4,663,104 | 5/1987 | Ito et al. . | |
| 4,673,659 | 6/1987 | Wood et al. . | |
| 4,741,131 | 5/1988 | Parker . | |
| 4,778,529 | 10/1988 | Barker et al. . | |
| 4,778,718 | 10/1988 | Nicholls . | |
| 4,781,816 | 11/1988 | Lee et al. . | |
| 4,856,236 | 8/1989 | Parker . | |
| 4,914,885 | 4/1990 | Baker et al. | 52/547 |
| 5,035,100 | 7/1991 | Sachs . | |
| 5,047,086 | 9/1991 | Hayakawa et al. . | |
| 5,059,371 | 10/1991 | Saheki et al. . | |

FOREIGN PATENT DOCUMENTS

| | | | |
|---|---|---|---|
| 0028023 | 7/1980 | Australia . | |
| 2245617 | 5/1990 | United Kingdom | 52/518 |

*Primary Examiner*—Carl D. Friedman
*Assistant Examiner*—Winnie Yip
*Attorney, Agent, or Firm*—William W. Haefliger

[57] ABSTRACT

A lightweight roofing shingle or tile having an elongated body with top and bottom surfaces that taper lengthwise of the body, the body having laterally spaced, elongated edges; the body having a mid-region and a recess sunk upwardly into the mid-region, from the bottom surface; the recess extending widthwise of the body to intersect the body laterally spaced edges whereby the recess is adapted to receive a batten to support the body mid-region when installed on a roof. A secondary taper on the tile bottom surface engages the roof to provide leverage resisting wind up-lift forces exerted on the lightweight tile acting to rotate the tile about a nailing point fulcrum.

11 Claims, 2 Drawing Sheets

LIGHTWEIGHT CEMENTITIOUS ROOFING

BACKGROUND OF THE INVENTION

This invention relates generally to the provision of lightweight, fireproof roofing tiles, capable of withstanding foot traffic as well as wind up-lift forces, and more particularly concerns cementitious in admixtures from which such roofing pieces are formed.

There is continuous need for improvements in lightweight cementitious tiles, and their installation, for example to prevent breakage during such installation, and thereafter, and to prevent tile up-lift due to wind.

Standard concrete and clay roofing tiles are installed with the butt end supported by the preceding tile and the tail end resting on the roof surface or "hung" on a narrow wooden batten. This means that the tile is unsupported between these points and must, therefore be strong enough to withstand foot traffic. Tests require that the product support 300 lbs. This required the use of excessively heavy tiles. Also, tiles made of lightweight cementitious or other materials do not withstand wind up-lift forces as well as heavy tiles do.

Prior roofing tiles and methods of production are disclosed, for example, in Jakel U.S. Pat. Nos. 3,841,885, Jakel 3,870,777, Kirkhuff 3,852,934 and Murdock 4,288,959, and Wood 4,673,659 describing problems encountered in lightweight extruded tile production.

SUMMARY OF THE INVENTION

It is a major object of the invention to provide improvements in the structure of, as well as the installation of, lightweight, roofing tiles made of cementitious or other materials.

Basically, and in accordance with one aspect of the invention, the improved roof tile has a) an elongated body with top and bottom surfaces that taper lengthwise of the body, the body having laterally spaced, elongated edges, b) the body having a mid-region and a recess sunk upwardly into that mid-region, from the bottom surface, c) the recess extending widthwise of the body to intersect the body laterally spaced edges, d) whereby the recess is adapted to receive a batten to support the body mid-region when installed on a roof.

As will appear, the batten typically has a substantially rectangular outline, and the recess is shaped so that the batten lower surface is spaced below a plane defined by the body and batten surfaces.

Another object is to provide tile hold down force creating means to increase wind up-lift resistance, as by tapering the tile bottom surface to provide leverage acting to prevent tile up-lift, or by clip attachment of tile notched edges to a roof batten. The clip is typically configured in such a way as to avoid hammer blows directly to the tile notched edges, and an improved clip is provided for this purpose.

Yet another object is to provide a flat tile which reduces the unsupported span of the installed tile, whereby lightweight tile may then be employed instead of heavier tile made of sand and rock concrete.

These and other objects and advantages of the invention, as well as the details of an illustrative embodiment, will be more fully understood from the following specification and drawings, in which:

DRAWING DESCRIPTION

Figure 1:
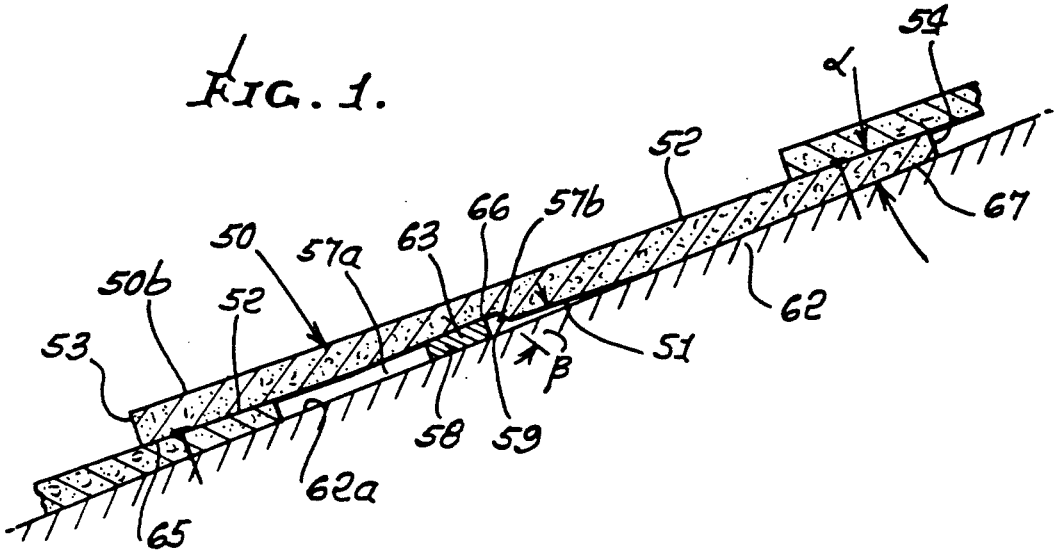
FIG. 1 is a section taken through a shingle or tile formed in accordance with the invention.
Figure 3A:
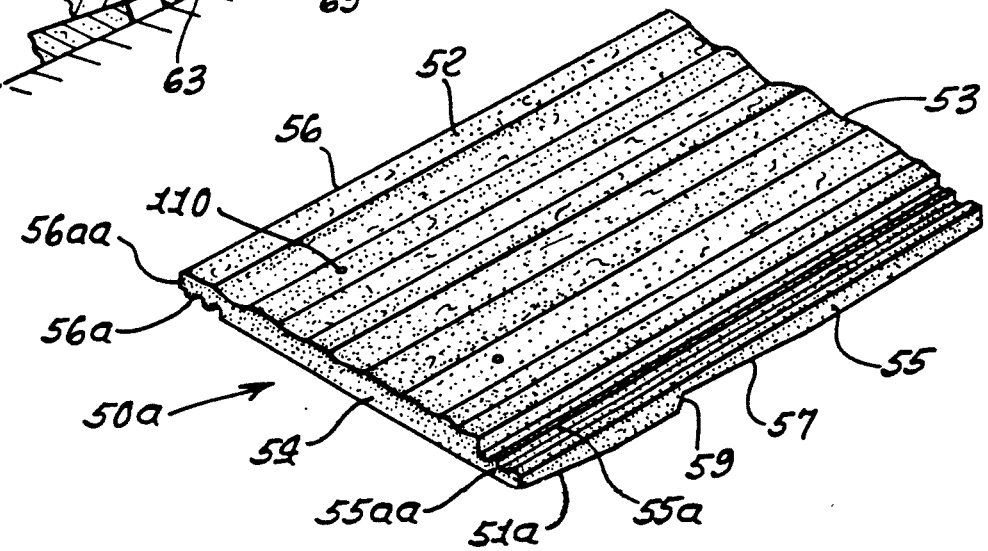
Figure 3B:
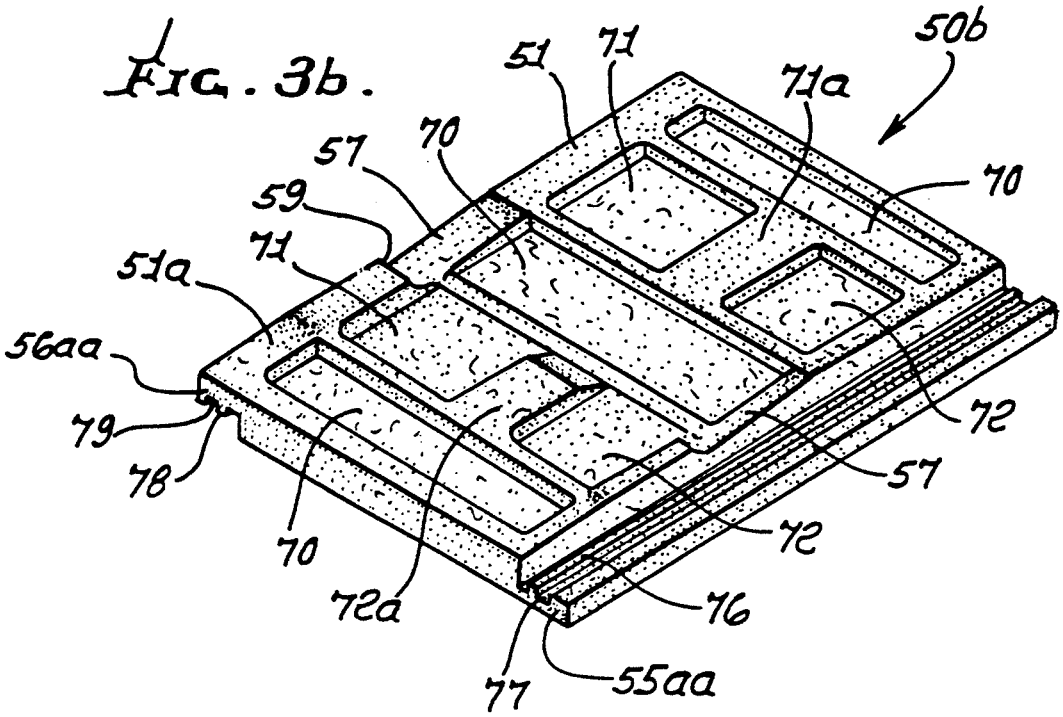
Figure 4:
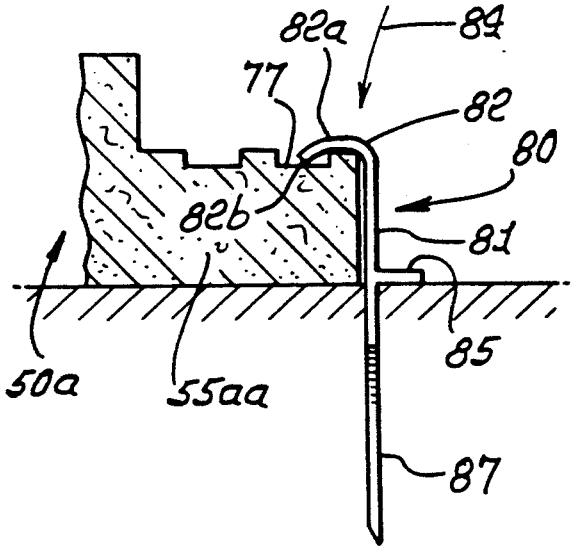
Figure 5:
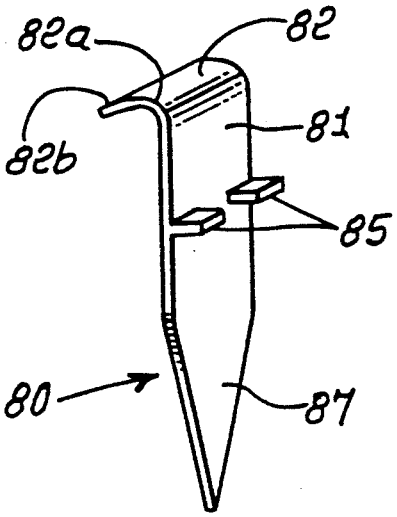

FIG. 3*a* is a perspective view of the top of the FIG. 1 tile;

FIG. 3*b* is a perspective view of the bottom of the FIG. 1 tile;

FIG. 4 is a side elevation showing use of a clip to hold the FIG. 3*a* and FIG. 3*b* tile to a roof; and FIG. 5 is a perspective view of the FIG. 4 clip.

DETAILED DESCRIPTION

Figure 2:
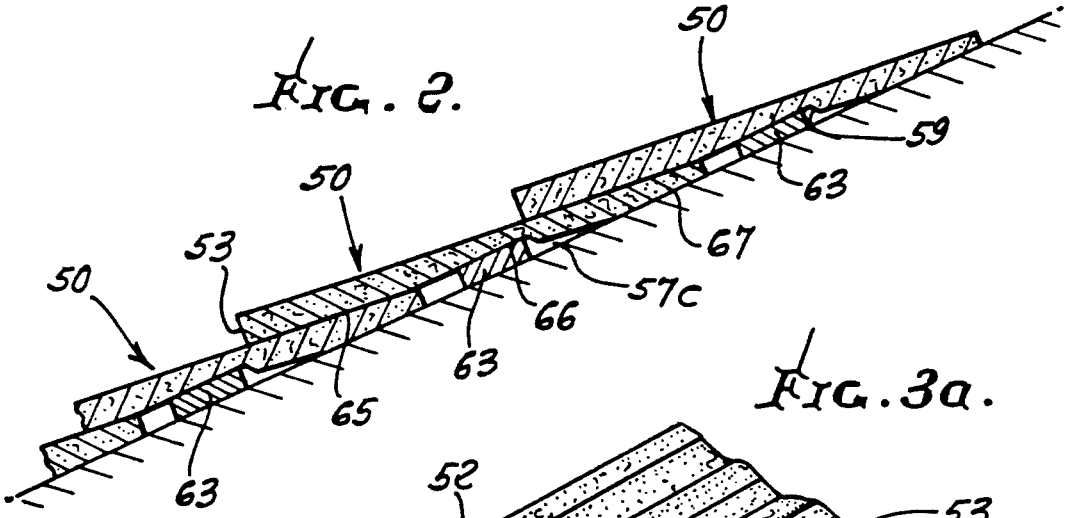
FIG. 2 shows the FIG. 1 tile installed on a roof.

In FIGS. 1, 2 and 3*a*, the tile or shingle 50 has a bottom side 51, top side 52, forward edge 53, rearward edge 54, and right and left edges at 55 and 56 (see FIG. 3*a*). The bottom side 51 defines a notch or recess 57 which extends between and through edges 55 and 56. That recess 57 has an interior surface 58 which tapers toward the plane of bottom side 51, at angle $\alpha$ (between 5° and 20°). A recess shoulder 59 extends at an acute angle $\beta$ to the plane of side 51, and intersects 58 and 51.

Interior surface 58 is substantially parallel to the top 62*a* of tile support roofing 62 (plywood, etc.), whereby a rectangular cross-section batten 63 may fit between 58 and 62*a* to support the mid-portion of the tile 50, as shown. Batten 63 is elongated, generally horizontally along the sloped roof, and projects into recess 57 as well as below the plane of shingle batten surface 51. A beveled portion 51*a* of the tile rear bottom side 51 is parallel to and flatly engages the roof, and is generally parallel thereto. The front portion 50*b* of the tile is directly supported on the rear of the top side 52 of the next lower tile 50 on the roof, as seen in FIG. 2. Each tile then has extensive three-point planar support, at 65, 66 and 67. Top surface 52 extends at angle $\alpha$ relative to 51*a* and 62*a*.

FIG. 2 shows a series of such tiles 50, supported as described, each tile having three-point planar support, as at 65, 66 and 67. Note that the tile forward edge 53, generally normal to the plane of top 52*m*, extends over recess 57 defined by the next lower tile; and bevel 51*a* is rearward of recess 57. The only unsupported extents of the tile are at short recess portions 57*a* and 57*b*, forward and rearward of the batten, and at narrow gap 57*c*, rearward of the shoulder 59. The shingle rearward edge 54 may be squared off, as shown.

The tile 50*a* shown in FIG. 3*a* is notched at 55*a* and 56*a*, notch 55*a* intersecting the top surface of the tile, the notch 56*a* intersecting the bottom surface of the tile. This enables overlying and underlying interfit of sidewardly adjacent tiles, with tile upper extent 56*aa* overlying next tile extent 55*aa*, during installation. The notches extend lengthwise throughout the tile length, and extend over the recess 57, at opposite ends thereof.

The tile 50*b* bottom side seen in FIG. 3*b* is also provided with hollow shallow cavities 70–72 of selected generally rectangular shape, to reduce the mass of the tile, thereby reducing each load. Hollow shallow cavities 71 and 72 are interfitted by ribs 71*a* and 72*a* to increase strength in the two created space areas on either side of the batten. One large rib on each side is shown; however, multiple ribs could be used. Large cavity 70 is formed between tapers 57. Elongated ridges and valleys 76 and 77 at the upper side of 55*aa* interfit elongated ridges and valleys 78 and 79 on the lower side of 56*aa*, on the next tile, to block water leakage transversing of such ridges and valleys. Pre-drilled or marked points for nailing the tiles, as at 110, are located under overlapping extents of next above tiles. Wind up-lift forces tending to rotate the tiles clockwise about nail fulcrum points, at 110, are resisted by tile taper at 51*a* flatly engaging roofing 62*a*.

FIGS. 4 and 5 show a metallic wind clip 80 usable with the FIGS. 3*a* and 3*b* tile 50*a* on 50*b* to hold it in place, against very high wind forces tending to lift the tile. The clip has an upright flat body 81, with an upward extension 82 crossing sidewardly leftwardly at 82*a* and downwardly at 82*b* to engage the surface of tile lower extent 55*aa*, and preferably into a groove as at 77 in 55*aa*. The clip upper extent 82 is spaced above 55*aa* so that hammer blows indicated by arrow 84, during nailing, are not directly received by 55*aa*, and are always absorbed by the clip body 81, at least to substantial extent preventing breakage of 55*aa*. Feet 85 project rightwardly from body 81 to engage the batten 63, and limit downward displacement of the clip, during nailing. Spike 87 on the clip extends downwardly to penetrate the batten, which is also nailed to the roofing 62*a*.

It is another object of the invention to provide a formulation of lightweight aggregates which have been graded and prepared in a very specific manner, and which, when mixed with Portland Cement in prescribed sequence, and specified mixer speeds, will produce a "dry" mix which can be easily extruded using existing extruding machines designed for standard concrete mixes, and which will extrude at very high speed on these machines without modification to the machine. The object is to make production of such lightweight tile products, as disclosed above, very efficient and therefore relatively inexpensive, compared to the slower "wet" processes being used currently.

It is yet another object to provide an aqueous, yet "dry" admixture that is extrudible to produce lightweight cementitious roofing tiles and shingles, that consist essentially of the components:

a) expanded perlite in particulate form b) an ingredient or ingredients selected from the group consisting of pumice and expanded shale, and expanded clay, that ingredient or those ingredients being in particulate form, and c) Portland Cement in particulate form.

Such an admixture also typically contains a small amount, by weight, of cellulose and loop polyester fiber. More specifically, the mix typically contains such components in relative weight amounts:

about 1 part of the above b) ingredient or ingredients
about 1 part Portland Cement,
about ½ part expanded perlite.

A further object is to provide an improved method of processing, including pre-screening of the aggregate, in order to produce a superior product. Thus, by grading standard sources of pumice, expanded shale or clay and expanded perlite into specific particle sizes and then re-combining them in a prescribed manner and sequence, a mix is created which can be bound together using common Portland Cement giving superior physical strength and maintaining a compacted weight only slightly heavier by volume than the aggregates themselves. The two grades, when recombined create an optimum range of particle sizes to be coated by the cement. Prior lightweight mixes using these aggregates (and other similar) did not remove the high quantities of fines (smaller than 50 mesh) in pumice, (pumicite) expanded shale and perlite. These fines have enormous surface area and use up large quantities of cement to bind them, which results only in increased weight, thus defacting the reason for using lightweight aggregates. Additionally, such prior mixes using too many fines are difficult to extrude or press into shapes, since they resist flow and tend to "spring back" after the pressure is removed. The resulting product, if it can be formed at all, is generally very low in strength due to the low compaction resulting from improper aggregate particle size distribution.

Yet another object is to provide a formula of lightweight aggregates, fiber and Portland Cement, which, when graded, prepared and mixed as described produces a lightweight, fire and thermal resistive concrete which can be successfully and easily extruded into shapes for use in construction, principally, roofing tiles, shingle and shakes as described above. This mix can also be pressed into the same shapes and brick and block shapes using pressure and vibration as in a paver or block production machine. The resultant compressed product is homogeneous and uniform thus creating superior strength characteristics compared to present lightweight fiber cement mixes. This "concrete" is approximately half the weight of traditional concrete (specific weight is 0.85 to 1.0, or expressed in metric, 0.85 gr. per cc.) and is half as strong and absorbs the same amount of water.

The admixture formula to produce the described shingles and tiles is as follows, with parts listed by relative weight:

| FORMULA: by weight |
|---|
| 1 part Portland Cement |
| .8 to 1.2 part Pumice (or expanded shale) |
| .3 to .4 part expanded Perlite |
| .015 to .025 part treated cellulose fiber (optional) |
| .005 to .015 part Polyester fiber (optional) |
| .2 to .3 part water (portion 1) |
| .4 to .6 part water (portion 2) |

GRADES

Where: The Portland Cement is Type II Common or Type III High Early or Type C Plastic.

Where: The Pumice or expanded shale or clay as received is dried to less than 1% moisture content and then screened to create a material having the following sieve analysis expressed in % by weight retained on screen:

| | | |
|---|---|---|
| 4 | mesh | 0–5 |
| 8 | mesh | 10–20 |
| 16 | mesh | 20–30 |
| 30 | mesh | 30–50 |
| 50 | mesh | 5–15 |
| Pan | | 5 max. |

This material has a specific weight of 0.80–0.90 weighing 40 to 60 lbs/ft$^3$.

Where: The expanded Perlite is screened (before or after expansion) to create a material having the following sieve analysis expressed in % by weight retained on screen:

| | | |
|---|---|---|
| 8 | mesh | 0–7 |
| 16 | mesh | 30–40 |

-continued

| | | |
|---|---|---|
| 30 | mesh | 25-35 |
| 50 | mesh | 15-25 |
| 80 | mesh | 0-6 |
| Pan | | 2 max. |

This material has a specific weight of 0.13–0.17 weighing 7 to 11 lbs/ft$^3$.

Where: The Polyester fiber is of 1.5 to 6.0 straight drawn and cut to 0.25 inch to 0.5 inch in length.

Where: The cellulose fiber is typically obtained from newsprint or kraft, opened fully by processing and moisture resistance treated.

PREPARATION

The Pumice, shale or clay preparation and handling prior to mixing must insure that the material does not segregate into concentrations of particle sizes within the grade. Anti-segregation methods of handling these aggregates must be employed in the transport and measuring systems.

The Pumice and/or shale must then be completely saturated with water (exposed to water until it stops increasing in weight) prior to mix start. Portion 1 of water is used for this purpose.

The Perlite must be handled (mixed for example) before and after expansion to insure that the particles do not segregate into concentrations of particle sizes within the grade. The Perlite may be either expanded "on demand" or handled insuring that the particles do not segregate prior to measuring and mixing.

MIXING

The sequence of the introduction of materials to the rotary mixer and the mixer rotor speeds and configuration are important:

1. The fiber, if used, is introduced into a rotating pan-high speed rotary mixter that has tip speeds in excess of 60 feet per second. Mix time continues until the fiber is completely opened.

2. Portland Cement is introduced into the fiber in the mixer and mixed at the same speeds until the fiber is fully dispersed into the cement.

3. The prepared Pumice or Shale is put into the mixer and rotor tip speeds reduced to 40 feet per second. The first portion of water has now been added. Mixing continues until homogeneity is reached.

4. Rotor tip speeds are further reduced to 10 to 12 feet per second prior to the introduction of Perlite. An alternate and preferred method is to transfer the mix from the rotating pan mixer to a folding paddle or screw type continuous mixer and to meter the Perlite into the mix.

5. The final mix with the second portion of water added may be at the low tip speed for very short time (10–15 seconds). Folding paddle or continuous screw (with back paddles) mixing is the preferred method to insure that the Perlite is not degraded by the mixing action.

Other common additives for concrete and lightweight cement or fiber cement products may be added at the appropriate places depending on the end use. These additives could include iron oxides for coloring, calcium chloride for curing acceleration, water repellant chemicals, etc. . . .

CURING

Product curing should begin immediately and in a controlled atmosphere. The humidity must be at least close to 80%. Temperature can vary from 100° F. to as high as 170° (170 should not be exceeded) depending upon need for early strength in the particular product being produced.

FORMING AND SHAPING

By changing water content and making slight adjustments to fiber type and amount, the mix can be formed and shaped in a variety of ways.

The principle method is extrusion where the forming pressure is approximately 200 lbs. per square inch and the typical extrusion method is as used to produce concrete roof tiles on a carrier pallet which creates the shape of the bottom of the tile and a roller and slipper shape the top surface, curing proceeding on the pallet or pallets, after which the shingles are removed. The lightweight mix does not have the strength of a typical concrete mix and therefore the shape of the tile and the thickness are modified in order that the resulting cured tile can withstand foot traffic and pass the required "as installed" strength testing. The top surface of the tile which is shaped by the roller and slipper on the extrusion machine can be modified to produce any shape from a smooth European tile to a rough random shape of a cedar shake. The bottom surface is shaped by the pallet, and the tapered tail end of the tile and displaced batten combine to reduce the effective span of the installed tile. FIG. 1 illustrates this.

Additionally, a shake shingle shape can be extruded using the same extrusion method. FIG. 2 illustrates the novel shape for such a shake shingle. This shape incorporates a sharp taper on the bottom surface as described in Murdock U.S. Pat. No. 4,288,959patent. Additionally, the underside is hollowed out in the same manner as with the concrete tile to further reduce the installed weight.

The second method of forming and shaping employs a standard paver or block forming machine as this mix easily and consistently is handled by such a machine without modification. Thus, products currently produced using standard heavy concrete mixes can, by using the present mix, be also produced in a lightweight version. The shapes for roofing tiles and shake shingles may also be produced on these machines.

ADDITIONAL ADVANTAGES

The formula of light and very light aggregates with Portland Cement and cellulose fibers produces a strong, flexible, fire resistive and insulative concrete. This formula, when properly prepared and mixed is easily shaped by extrusion and vibrative pressure by unmodified industry standard machines used in making standard machines used in making standard heavy traditional concrete.

A combination of various grades of light and very light aggregates combined in described quantities as disclosed creates a balance and uniformity of particle sizes. This combination of particle sizes, when combined with Portland Cement, produces a uniformly graded and therefore strong concrete referred to as "Perlacem".

The method of preparing very light aggregate as disclosed is such that the particle distribution will remain constant and not vary due to ore changes or by storage segregation. This eliminates the common problem of water "take-up" variation which creates forming and shaping problems.

The formula of light and very light aggregates, graded and prepared as disclosed is such that maximum binding effect of the Portland Cement is achieved. Previous lightweight mixes using the same aggregates embodied too many of the naturally occurring fines (very small particles of the minus 50 mesh variety) and thus created an ineffective cement paste.

The present tile design is such that the effective span of the installed tile is greatly reduced by using a tapered tail section and a displaced batten. The present shake shingle can be hollowed out and made much thicker than those presently manufactured, and it employs a sharp taper to achieve a flat layup on the roof.

I claim:

1. A roofing shingle or tile having:

a) an elongated body with top and bottom surfaces that taper lengthwise of the body, said body having laterally shaped, elongated edges, b) said body having a mid-region and a recess sunk upwardly into said mid-region, from said bottom surface, the recess having a bottom surface, c) said recess extending widthwise of the body to intersect said body laterally spaced edges, d) and including a batten received in the recess to support the body mid-region when installed on a roof, said batten also projecting outwardly of the recess, beneath said body, to flatly engage the roof, e) the batten having a rectangular cross-section with opposite parallel sides to respectively flatly engage the bottom surface of the recess and the roof surface.

2. The tile or shingle of claim 1 wherein the body consists of cementitious material.

3. The tile or shingle of claim 1 wherein the body consists of cementitious material, and said batten consists of wood.

4. The tile or shingle of claim 3 wherein the body is notched, lengthwise thereof, and inwardly of said elongated edges, one notch intersecting said recess.

5. The tile or shingle of claim 1 wherein the body is notched, lengthwise thereof, and inwardly of said elongated edges, one notch intersecting said recess.

6. The tile or shingle of claim 5, and including a fastener to retain the notched edge of the body attached to a roof, said fastener having an upper arched extent that bears on the notched edge of the body, a foot to bear on the batten, and a prong to penetrate the batten.

7. The tile or shingle of claim 1 wherein said recess bottom surface is an inner support surface for said batten, and extending at an angle $\alpha$ relative to the shingle or tile top surface, wherein said angle $\alpha$ is between 5° and 20°.

8. The tile or shingle of claim 1 wherein the body bottom surface has a secondary taper to flatly engage the roof near an upper end of the elongated body, whereby the elongated body may be nailed to the roof in spaced relation to said end so that said secondary taper engagement with the roof provides leverage resisting wind up-lift forces exerted to the elongated body near a lower end of the tile.

9. A roofing shingle or tile having:

a) an elongated body with top and bottom surfaces that taper lengthwise of the body, said body having laterally shaped, elongated edges, b) said body having a mid-region and a recess sunk upwardly into said mid-region, from said bottom surface, c) said recess extending widthwise of the body to intersect said body laterally spaced edges, d) whereby the recess is adapted to receive a batten to support the body mid-region when installed on a roof, e) said shingle or tile having a composition that consists essentially of the components:

i) expanded perlite in particulate form, ii) an additional ingredient or ingredients selected from the group consisting of pumice and expanded shale, said additional ingredient or ingredients being in particulate form, and iii) Portland cement in particulate form, said composition having been hydrated and cured.

10. The shake or shingle of claim 9 including a small amount by weight, relative to each of said perlite, additional ingredient, and cement components, of at least one of the following:

cellulose fiber polyester fiber.

11. The shake or shingle of claim 9 wherein said components are present in relative weight amounts:

0.8 to 1.2 part additional ingredient or ingredients about 1 part Portland cement 0.3 to 0.4 expanded perlite.

* * * * *